US011193452B2

(12) United States Patent
Graves

(10) Patent No.: US 11,193,452 B2
(45) Date of Patent: Dec. 7, 2021

(54) CARBURETOR DRAIN VALVE

(71) Applicant: Christopher M Graves, Milwaukee, WI (US)

(72) Inventor: Christopher M Graves, Milwaukee, WI (US)

( * ) Notice: Subject to any disclaimer, the term of this patent is extended or adjusted under 35 U.S.C. 154(b) by 0 days.

(21) Appl. No.: 17/023,931

(22) Filed: Sep. 17, 2020

(65) Prior Publication Data

US 2021/0190015 A1 Jun. 24, 2021

Related U.S. Application Data

(60) Provisional application No. 62/902,248, filed on Sep. 18, 2019.

(51) Int. Cl.
*F02M 5/12* (2006.01)
*F02M 17/36* (2006.01)

(52) U.S. Cl.
CPC ..... *F02M 5/12* (2013.01); *F02M 17/36* (2013.01)

(58) Field of Classification Search
CPC ..... F02M 5/12; F02M 17/36
See application file for complete search history.

(56) References Cited

U.S. PATENT DOCUMENTS 2,325,325 A * 7/1943 Kiene ..... F16K 1/36 251/340
3,825,238 A * 7/1974 Nishihara ..... F02M 17/06 261/36.2
3,874,478 A * 4/1975 Mantell, Jr. ..... F01M 11/0408 184/1.5
3,948,481 A * 4/1976 Pollock ..... F01P 11/0276 251/351
4,025,048 A * 5/1977 Tibbitts ..... F01M 11/0408 251/144
4,033,432 A * 7/1977 Bernstein ..... F01M 11/0408 184/1.5
4,088,715 A * 5/1978 Graybill ..... F02M 7/11 261/121.3
4,231,544 A * 11/1980 Balch ..... F01M 11/0408 137/351
4,440,193 A * 4/1984 Matheson ..... F16K 1/302 137/558
4,512,547 A * 4/1985 Balch ..... F24D 19/088 251/115
4,745,894 A * 5/1988 Laipply ..... F01M 11/0408 123/196 R
4,815,566 A * 3/1989 Caruso ..... F01M 11/0408 184/1.5
4,893,651 A * 1/1990 Herman ..... B01D 36/006 137/588

(Continued)

*Primary Examiner* — Thomas N Moulis
(74) *Attorney, Agent, or Firm* — Joseph S. Heino; Erin E. Kaprelian

(57) ABSTRACT

A carburetor drain valve, comprises a valve body and a valve center screw. The valve body further comprises a threaded inner portion and a plurality of carburetor screw threads. The valve center screw further comprises a threaded outer portion to couple to the valve body at the threaded inner portion. A valve screw handle is disposed at a lower portion of the valve center screw, and a plug portion is disposed at an upper portion of the valve center screw. An opening is disposed along the length of the valve center screw, and a cross-drilled hole is disposed within the plug portion.

8 Claims, 2 Drawing Sheets

(56) References Cited

U.S. PATENT DOCUMENTS

| | | | | | |
|---|---|---|---|---|---|
| 4,951,723 | A * | 8/1990 | Hoeptner, III | F01M 11/0408 | 141/346 |
| 5,057,249 | A * | 10/1991 | Baltz | F02M 5/14 | 261/72.1 |
| 5,124,084 | A * | 6/1992 | Eide | F02M 5/12 | 261/4 |
| 5,368,788 | A * | 11/1994 | Boyesen | F02M 5/02 | 261/44.3 |
| 5,535,794 | A * | 7/1996 | Posly | B66F 9/06 | 141/351 |
| 5,908,086 | A * | 6/1999 | Conklin | F01M 11/0408 | 184/1.5 |
| 6,244,572 | B1 * | 6/2001 | Delsole | F02M 5/12 | 141/364 |
| 6,443,427 | B2 * | 9/2002 | Coupal | F16K 31/504 | 184/1.5 |
| 6,609,699 | B2 * | 8/2003 | Chen | F01M 11/0408 | 184/1.5 |
| 6,729,608 | B1 * | 5/2004 | Del Sole | F02M 17/36 | 141/364 |
| 7,134,641 | B2 * | 11/2006 | Jensen | B01D 35/153 | 251/149.8 |
| 9,482,363 | B2 * | 11/2016 | Chen | F16K 31/50 | |
| 9,562,495 | B1 * | 2/2017 | Tucak | F02M 17/42 | |
| 9,897,229 | B2 * | 2/2018 | Dillon | F16K 27/067 | |
| 2007/0025099 | A1 * | 2/2007 | Urban | F02M 37/32 | 362/101 |
| 2016/0082370 | A1 * | 3/2016 | Morris | B01D 36/003 | 210/799 |
| 2020/0025153 | A1 * | 1/2020 | Tamas | F02M 21/0242 | |

* cited by examiner

CARBURETOR DRAIN VALVE

PRIORITY

This application claims priority from Provisional Application No. 62/902,248, filed on Sep. 17, 2019, the contents of which are hereby incorporated by reference.

BACKGROUND

Motorcycle and powersports riders often drain the fuel from their carburetors. Many riders do this to "winterize" their motorcycles, to keep fuel from sitting in the carburetor throughout the winter. Winterizing a motorcycle by removing fuel prevents the old fuel from becoming "gummy" or causing damage to the carburetor. Although the application described herein is primarily directed to motorcycles, it is apparent that this draining can be performed for other vehicles.

DETAILED DESCRIPTION

Figure 1:
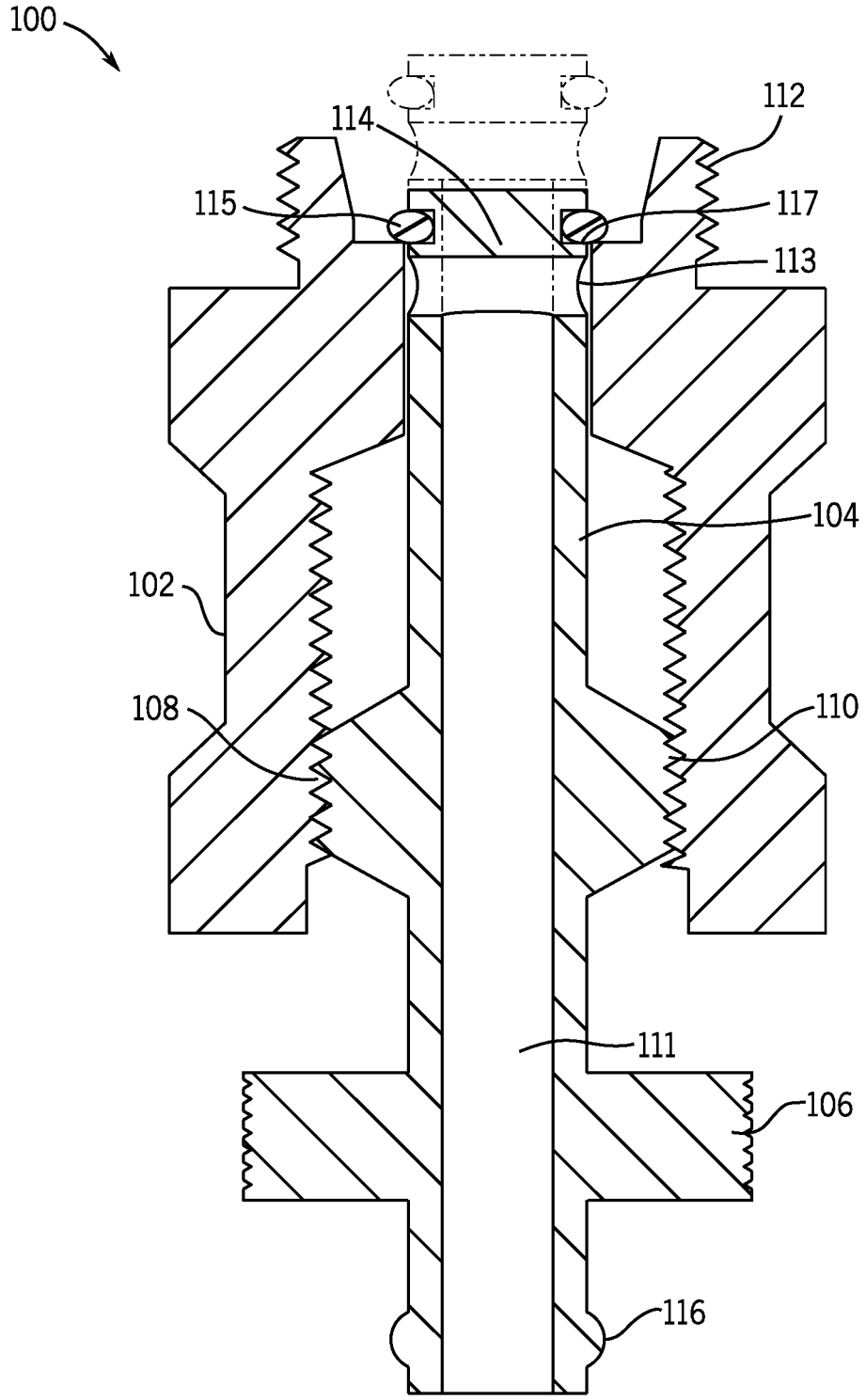
FIG. 1 is a cross-section of a carburetor drain valve consistent with the present disclosure.

Motorcycle riders, as well as other powersports riders, often drain the fuel from the motorcycle carburetors. As used herein, the word "motorcycle" can be used interchangeably with the more colloquial word "bike". This draining can be done for a variety of reasons. In colder climates, removal of fuel may be part of a larger "winterization" process, where the bike is prepared to be stored for a period of time. As part of this process, the fuel may be removed from the bike, so that the fuel does not sit in the carburetor for an extended period of time. If the fuel is not removed, the rider runs the risk of the old fuel becoming "gummy" or thickened. This thickened fuel can deposit itself on smaller components within the carburetor, such as fuel jets. As a result, when the rider is ready to use the bike again, the carburetor may not function properly. The rider may then need to do more extensive work, such as deep cleaning the carburetor, before the bike is ready for use.

In addition, fuel may need to be drained from a carburetor in order to perform maintenance. If a rider wants to change fuel jet sizes or perform other carburetor maintenance, draining the fuel is a necessary first step. This is primarily for ease and safety; since fuel is flammable, removing it from the carburetor greatly reduces the risk of a fuel-related accident.

Most motorcycle carburetors are fitted with a drain plug and drain port to be used when draining fuel. Traditionally, these drain plugs are configured to be removed with a wrench or similar tool. However, on many motorcycle engine/carburetor configurations, it can be difficult for a mechanic or rider to keep from spilling fuel onto adjacent vehicle and engine components. This is because once the drain plug is removed, the fuel spills out in a very short period of time (often just a few seconds). As a result, there is not sufficient time to both pull the drain plug out of the way and insert a container to catch the fuel below the drain port.

In addition, the shape of the engine on a motorcycle may hinder the ability of the mechanic or rider to find a container that can be placed, and self-supported, below the drain plug. This means that, in order to catch the draining fuel, the mechanic or rider needs to manually hold a small container directly under the drain port to catch the fuel. However, this often results in fuel being spilled onto engine components, as well as onto other vehicle components, that are below the drain port. This can cause damage to painted finishes on the vehicle, resulting in additional expense for the rider to fix and protect the damaged area. As used herein, the word "vehicle" broadly covers motorcycles, bikes and other equipment that requires a fuel holder of the type described herein.

A carburetor drain valve consistent with the present disclosure, by contrast, allows a mechanic or user to drain fuel from the carburetor in such a way that the amount of fuel spilled is lessened or minimized. In addition, a carburetor drain valve consistent with the present disclosure may eliminate the need to use tools to open the drain plug, meaning that a rider or mechanic is does not have to scramble to place a fuel catching container in place once the drain plug is opened. The carburetor drain plug, as installed and placed when the bike was built, may be removed, and a carburetor drain valve consistent with the present disclosure may be installed in its place. The carburetor drain valve of the present disclosure may be alternately placed in a "closed" or "open" position, to allow for selective draining of fuel from the carburetor.

FIG. 1 is a cross-section of a carburetor drain valve 100 consistent with the present disclosure. Carburetor drain valve 100 consists of a valve body 102 and a valve center screw 104. As can be seen in FIG. 1, the valve center screw 104 engages with an inner portion of the valve body 102. A valve screw handle 106 extends past the lowest portion of the valve body 102, allowing the valve center screw to be loosened or tightened, or opened or closed, by a user.

As shown in FIG. 1, valve body 102 includes a plurality of valve body threads 108. As used herein, a thread refers to a helical ridge on the outside of a screw or bolt, or on the inside of a cylindrical hole, to allow two parts to be coupled to one another. In the case of valve body 102, valve body threads 108 may be disposed internally to receive the valve center screw 104. More particularly, the valve center screw 104 may include a plurality of valve screw threads 110. The valve center screw threads 110 may couple with the valve body threads 108, allowing the valve center screw 104 to be coupled to the valve body 102. In some examples, the valve screw threads 110 may be left-hand threads. This may allow valve center screw 104 to be opened by turning valve screw handle 106 in a counterclockwise direction and to be closed by turning valve screw handle 106 in a clockwise direction. By contrast, right-hand threads would result in valve center screw 104 being opened, or loosened, when valve screw handle 106 was turned in a counterclockwise direction.

Valve center screw 104 may be substantially hollow. That is, valve center screw 104 may have an opening 111 running the length, or the majority of the length, of valve center screw 104. Opening 111 may be the means by which fuel is drained from the carburetor when the carburetor drain valve 100 is being used to drain fuel. This process is discussed further herein with respect to FIG. 2 and later with respect to FIG. 1.

Valve body 102 may couple to a carburetor (not pictured in FIG. 1) at a plurality of carburetor screw threads 112. Carburetor screw threads 112 may couple to, or screw into, the carburetor. More particularly, carburetor screw threads 112 may couple to the carburetor at the location where the drain plug ordinarily would be located.

Valve center screw 104 may have a plug portion 113 located at a top portion thereof, opposite the valve screw handle 106. The plug portion 113 may alternate between an open position and a closed position. When in the closed position, plug portion 113 may provide a seal between the carburetor and the environment; that is, plug portion 113 may prevent the fuel in the carburetor from flowing out. By contrast, when plug portion 113 is in an open position, the seal between the carburetor and the environment may be broken. Plug portion 113 may be open when the valve center screw 104 is in a lowest position. In some examples, the plug portion 113 may seal the carburetor using an O-ring 115, although examples are not so limited. Disposed beneath the O-ring 115 is a circumferential indent 117. The circumferential indent 117 may serve to facilitate flow of fuel between the carburetor and the opening 111. Said differently, the circumferential indent 117 may prevent the plug portion 113 from butting up directly against, or contacting directly, the valve body 102. This may prevent a seal from being created that would impede the flow of fuel when draining occurs.

In addition, when plug portion 113 is in an open position, the opening 111 of valve center screw 104 may intersect with a cross-drilled hole 114. As shown in FIG. 1, the cross-drilled hole 114 may be located within plug portion 113, although examples are not so limited. When plug portion 113 is in an open position, cross-drilled hole 114 may intersect with opening 111. This may allow fuel to flow from the carburetor through opening 111 and out of valve 100. In some examples, the fuel may flow out of valve 100 at a hose barb end 116. As used herein, a hose barb end 116 refers to a portion of valve body 102 that has barbs or protrusions that may receive a fuel hose (not shown). When a fuel hose is attached to the valve 100 at hose barb end 116, the user may further divert the fuel draining out of the carburetor.

Importantly, the ability to selectively open and close the valve center screw 106 permits a user to control the rate at which fuel flows out of the carburetor when draining fuel. If a user wants a slower rate of fuel flow, the user may only open the valve center screw 106 slightly, such that cross-drilled hole 114 partially intersects opening 111. To increase the rate of fuel flow, the user may further open the valve center screw 106, thus increasing the amount of intersection between cross-drilled hole 114 and opening 111.

Figure 2:
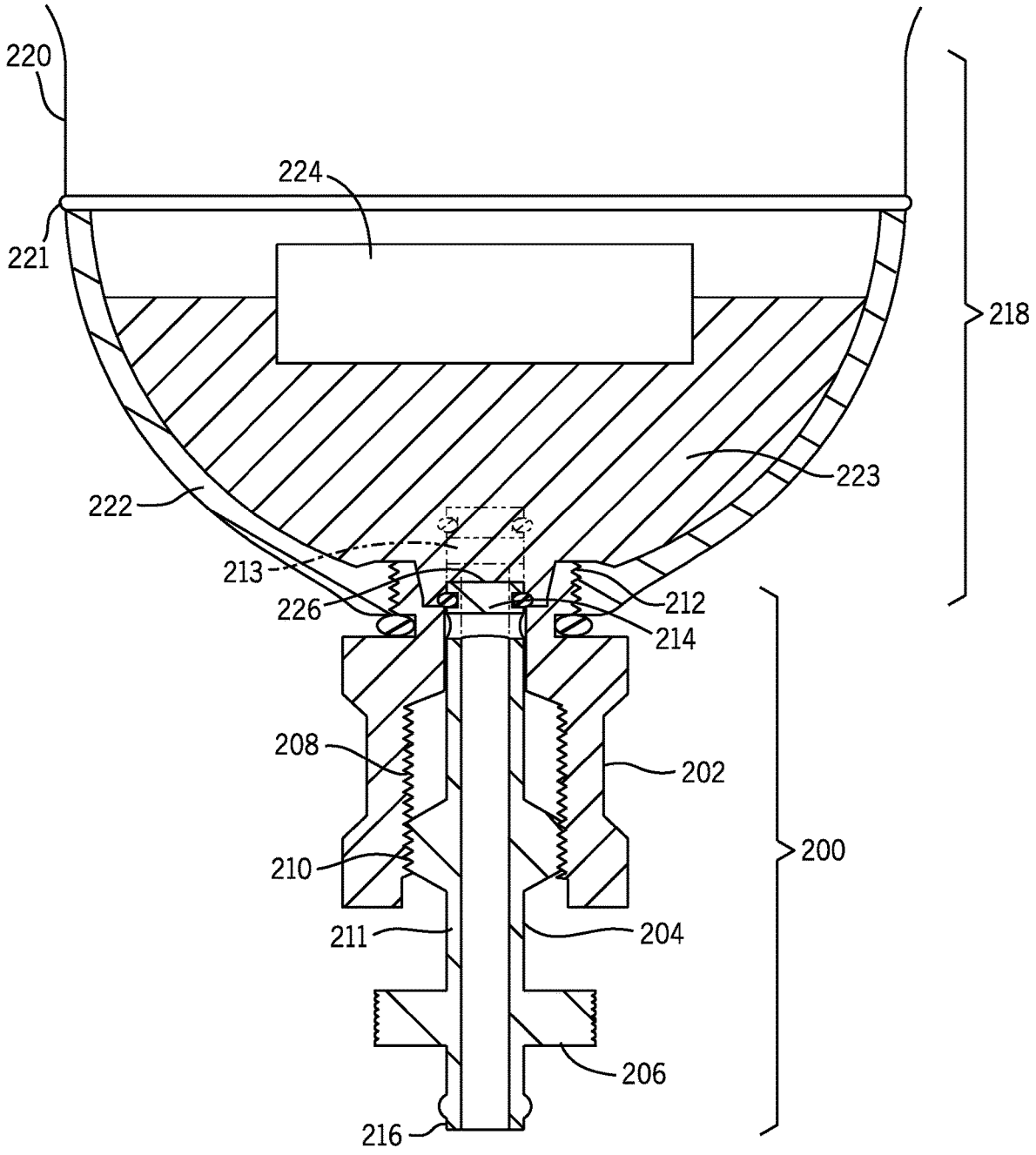
FIG. 2 is a cross-section of a carburetor drain valve as installed in a carburetor consistent with the present disclosure.

FIG. 2 is a cross-section of a carburetor drain valve 200 as installed in a carburetor 218 consistent with the present disclosure. Carburetor 218 is made up of a carburetor body 220 and a carburetor float bowl 222, which may be separated by a gasket 221. As shown in FIG. 2, carburetor float bowl 222 may have some amount of fuel 223 contained therein; this level may fluctuate when the bike is being used or when maintenance is being performed. A float 224 may be disposed within carburetor float bowl 222 and may float atop fuel 223.

A drain port 226 may be disposed at a lower portion of carburetor float bowl 222. The drain port 226 may be the location through which fuel, such as fuel 223, is drained when maintenance is performed. As discussed previously, a drain plug may typically be used to seal and close the drain port 226; however, as discussed with respect to FIG. 1, a carburetor drain valve 200 consistent with the present disclosure may be used as a replacement for the drain plug (also not shown).

Drain valve 200 may be akin to drain valve 100, discussed with respect to FIG. 1, and may include a valve body 202 and a valve center screw 204, with a valve screw handle 206 extending past the lowest portion of valve body 202.

As discussed with respect to FIG. 1, valve body 202 may include a plurality of valve body threads 208 to receive valve center screw 204 and, more particularly, to mate with valve screw threads 210. This may allow valve center screw 204 to move vertically with respect to valve body 202.

Valve body 202 may be coupled to carburetor float bowl 220 at drain port 226. As discussed with respect to FIG. 1, valve body 202 may include a plurality of carburetor screw threads 212. Drain port 226 may be a tapped hole; that is, drain port 226 may be a threaded hole drilled into the wall of carburetor float bowl 220, such that drain port 226 may receive a threaded screw, plug, or other closure item. In the present example, the valve body 202 may couple with the drain port 226 at the plurality of carburetor screw threads 212.

Once valve body 202 is coupled to the carburetor float bowl 220 at the drain port 226, a portion of the valve center screw 204 may extend into the carburetor float bowl 220. More particularly, a plug portion 213 of the valve center screw 204 may extend into the carburetor float bowl 220. As discussed with respect to FIG. 1, the plug portion 213 may seal the carburetor 218, and more particularly the carburetor float bowl 220, when the valve center screw 204 is in a "closed" or tightened position. By contrast, the seal may be broken when the valve center screw 204 is in an "open" or loosened position, which may allow fuel, such as fuel 223, to flow out of the carburetor float bowl 220. As discussed with respect to FIG. 1, valve center screw 204 may include a valve screw handle 206 for turning valve center screw 204. In addition, plug portion 213 may have a cross-drilled hole 214 therein.

Valve center screw 204 may have an opening 211 disposed substantially along its length. As discussed with respect to FIG. 1, the opening may allow for fuel, such as fuel 223, to drain from the carburetor float bowl 220. When valve center screw 206, and more particularly plug portion 213, are in an open position, the cross-drilled hole 214 contained within the plug portion 213 may intersect with opening 211. As a result, fuel 223 may flow out of carburetor float bowl 222, through the opening 211. In some examples, a fuel hose may be coupled to valve body 202 at a hose barb end 216, which may allow a user to further divert the fuel.

Importantly, the valve center screw 204 of the present disclosure, as discussed with respect to FIGS. 1 and 2, may have a recessed design. Said differently, the top portion of valve center screw 104, 204 may be disposed below the top surface of carburetor float bowl 222 when the valve center screw 104, 204 is in the closed position. This may help to ensure that the fuel supply is not affected by the presence of the carburetor drain valve 100, 200.

In the foregoing detailed description of the present disclosure, reference is made to the accompanying drawings that form a part hereof, and in which are shown by way of illustration how examples of the disclosure may be practiced. These examples are described in sufficient detail to enable those of ordinary skill in the art to practice the examples of this disclosure, and it is to be understood that other examples may be utilized and that process and/or structural changes may be made without departing from the scope of the present disclosure.

The figures herein follow a numbering convention in which the first digit corresponds to the drawing figure number and the remaining digits identify an element or component in the drawing. Elements shown in the various figures herein can be added, exchanged, and/or eliminated so as to provide a number of additional examples of the present disclosure. In addition, the proportion and relative scale of the elements provided in the figures are intended to illustrate the examples of the present disclosure and should not be taken in a limiting sense.

The invention claimed is:

1. A carburetor drain valve, comprising:

a valve body, the valve body further comprising:

a threaded inner portion;

a plurality of carburetor screw threads; and a valve center screw, the valve center screw further comprising:

a threaded outer portion to couple to the valve body at the threaded inner portion;

a valve screw handle disposed at a lower portion of the valve center screw;

a plug portion disposed at an upper portion of the valve center screw;

an opening disposed along the length of the valve center screw; and a cross-drilled hole disposed within the plug portion.

2. The carburetor drain valve of claim 1, wherein:

the valve body couples to a carburetor float bowl at a drain port; and the valve body couples to the carburetor float bowl at the carburetor screw threads.

3. The carburetor drain valve of claim 1, wherein the plug portion further comprises an O-ring to seal with the carburetor float bowl.

4. The carburetor drain valve of claim 1, wherein the valve center screw is vertically movable with respect to the valve body.

5. The carburetor drain valve of claim 4, wherein the plug portion moves with the valve center screw.

6. The carburetor drain valve of claim 1, wherein the plug portion is selectively movable between an open position and a closed position.

7. The carburetor drain valve of claim 6, wherein the cross-drilled hole intersects the opening within the valve center screw when the plug portion is in the open position.

8. The carburetor drain valve of claim 6, wherein the plug portion seals the carburetor float bowl when the plug portion is in the closed position.

* * * * *